US007179166B1

(12) United States Patent
Abbott

(10) Patent No.: US 7,179,166 B1
(45) Date of Patent: Feb. 20, 2007

(54) REEL GAME REQUIRING SKILL TO WIN

(76) Inventor: Thomas S. Abbott, P.O. Box 321, Oak Island, NC (US) 28465

( * ) Notice: Subject to any disclaimer, the term of this patent is extended or adjusted under 35 U.S.C. 154(b) by 212 days.

(21) Appl. No.: 09/663,661

(22) Filed: Sep. 15, 2000

(51) Int. Cl.
*A63F 9/24* (2006.01)

(52) U.S. Cl. ..... 463/9; 463/25; 463/36; 273/429; 273/432; 273/440; 273/461

(58) Field of Classification Search ..... 463/16, 463/23, 20–22; 273/237, 138.1, 139, 143 R
See application file for complete search history.

(56) References Cited

U.S. PATENT DOCUMENTS

| | | | | |
|---|---|---|---|---|
| 3,650,535 | A * | 3/1972 | Ohki | 273/143 R |
| 3,735,982 | A | 5/1973 | Gerfin | 273/1 E |
| 3,865,368 | A | 2/1975 | Grazebrook | 273/1 E |
| 4,501,422 | A * | 2/1985 | Leshik | 463/7 |
| 4,530,499 | A | 7/1985 | Breslow et al. | 273/1 GC |
| 4,804,185 | A | 2/1989 | Noble et al. | 273/85 CP |
| 5,407,199 | A | 4/1995 | Gumina | 273/139 |
| 5,584,763 | A | 12/1996 | Kelly et al. | 463/16 |
| 5,833,536 | A | 11/1998 | Davids et al. | 463/11 |
| 5,908,353 | A | 6/1999 | Andrews | 463/13 |
| 5,971,850 | A | 10/1999 | Liverance | 463/23 |
| 6,004,208 | A * | 12/1999 | Takemoto et al. | 463/20 |
| 6,165,070 | A * | 12/2000 | Nolte et al. | 463/20 |
| 6,174,234 | B1 * | 1/2001 | Seibert et al. | 463/20 |
| 6,190,254 | B1 * | 2/2001 | Bennett | 463/13 |
| 6,306,034 | B1 * | 10/2001 | Sakamoto et al. | 463/20 |
| 6,315,663 | B1 * | 11/2001 | Sakamoto | 463/20 |

* cited by examiner

*Primary Examiner*—Mark Sager
(74) *Attorney, Agent, or Firm*—Michael E. Mauney

(57) ABSTRACT

A reel based game that requires skill, fast reflexes, good memory, and strategy to play well. In the preferred embodiment, a video screen is used to electronically display the apparent rotation of several reels. A player presses a stop button to stop the rotation of the reels. If a player can stop a symbol on the reel in a required location on the screen, then the player is rewarded according to a pre-determined table of rewards. In an electronic version of the game, there can be a bonus symbol that allows a player to enter a bonus round where rewards are higher. A player can use concentration and memory to increase the likelihood of successfully stopping desired symbols in the appropriate location by recognizing what symbols appear in what order on the reels. In an electronic version of the game, the symbols will be periodically shuffled on the reel to renew the challenge for a player. The reels rotate at a speed that allows a player with concentration and skill developed by practice to be successful on a consistent basis in stopping a desired symbol in the winning location.

35 Claims, 5 Drawing Sheets

*Freeze Frame*

THE BET IS PRESET AT 20

1. Press the START Button.
2. The game will select a Bonus Symbol
3. Using the Freeze Frame Buttons stop the desired symbol to, make a winning combination, in the center frame of each reel.
4. Freeze the Bonus Symbols in the center frames for Bonus Spins.
5. You must freeze at least one reel before the timer runs out or you cannot win, and the bet will be returned.
6. The winning combinations are listed below:

| Combinations | Credits |
|---|---|
| Any One Bonus Hit Pays | 40 |
| Any Two Bonus Hit Pays | 350 |
| Any Three Bonus Hit Pays | 1200 |
| Any Two Hit Pays | 0 |
| Any Three Hit Pays | 4 |
| Hit the Same Two | 50 |
| Hit the Same Three | 700 |
| Double Bonus Spin Pays Max of | 3600 |
| Triple Bonus Spin Pays Max of | 8100 |

Press Start to Return to The Game.

10
FREEZE FRAME
20
41
Bonus
Symbol
Bonus
3 Symbols
2 time(s)
2 Symbols
3 time(s)
Spins
CREDIT
WIN
BET
43
HOW TO PLAY
42
26
21
22
23
24
25
70

FIG. 3

*Freeze Frame*

THE BET IS PRESET AT 20

1. Press the START Button.
2. The game will select a Bonus Symbol
3. Using the Freeze Frame Buttons stop the desired symbol to, make a winning combination, in the center frame of each reel.
4. Freeze the Bonus Symbols in the center frames for Bonus Spins.
5. You must freeze at least one reel before the timer runs out or you cannot win, and the bet will be returned.
6. The winning combinations are listed below:

| Combinations | Credits |
|---|---|
| Any One Bonus Hit Pays | 40 |
| Any Two Bonus Hit Pays | 350 |
| Any Three Bonus Hit Pays | 1200 |
| Any Two Hit Pays | 0 |
| Any Three Hit Pays | 4 |
| Hit the Same Two | 50 |
| Hit the Same Three | 700 |
| Double Bonus Spin Pays Max of | 3600 |
| Triple Bonus Spin Pays Max of | 8100 |

Press Start to Return to The Game.

REEL GAME REQUIRING SKILL TO WIN

FIELD OF THE INVENTION

The present invention relates to a game device where skill, fast reflexes, good memory, and strategy all combine to enable a skilled player to consistently score better than an unskilled player. In most applications, the game will be electronically implemented but a mechanical game is possible.

BACKGROUND OF THE INVENTION

Various games, and devices to implement those games, have been known for centuries. Some games involve highly specialized physical skills where a player pits himself on a common playing ground against the scores accumulated by other players. Examples of this type of game would be golf or bowling. In other games, players play each other with usually the more skillful prevailing. Games like racket ball or tennis are examples of this type of game. Other games where players are pitted against each other involve almost entirely mental skills developed through playing of the game. Examples of this would be chess or checkers. Other games where players are pitted against each other introduce an element of chance, usually, through some kind of random number generator-like device. Examples of this might be a poker game or bridge.

On the other hand, some games have been adopted to be used in casino-like gambling settings. Here, ordinarily, randomness plays a much larger role than does the skill of the player. Also, one ordinarily plays the house as opposed to the other players. For many years, this type of gambling was illegal in most states. However, within the last two decades, the spread of casino-like gambling, where the house bankrolls the games and pays the players, has become common and widespread, with many states legalizing certain types of gambling.

For this type of gambling and the gaming devices which are used for this type of gambling, the regulatory climate is very complex. There are federal laws that relate to gaming devices and interstate gambling. Moreover, each state has its own set of gambling laws and frequently within the state there may be jurisdictions that are outside of those laws or at least are not strictly bound by those laws (i.e., Indian reservations). Thus, there are some jurisdictions, like Nevada, where virtually any type of gambling device is allowed although the gambling industry is closely regulated. There are other states, like North Carolina, where very few, if any, gambling devices are permitted and where pay offs, even on skill-based games, are strictly limited.

Traditionally, games were played mechanically with a deck of cards, with a roulette wheel, with a pair of dice, with a wheel of fortune or keno wheel, or the like. The random outcome of the gaming device resulted from the shuffle of the cards, the roll of the dice, or so on. However, with the advent of electronic computers and compact central processing units, it has been possible to play games using electronically generated cards, dice, reels, wheels, and the like. The electronic control of the indicia of the game allows the operator of the game ordinarily to completely control the outcome of the game. That is, if the operator of the game wishes to set the game to where there is a 10% return for the house, it can be easily done. For example, in video poker games a player decides on a bet, cards are dealt to the player, usually there is a draw in which the player can exercise some skills regarding his knowledge of poker to improve his likelihood of achieving a favorable outcome, the play of a single game is concluded, and the player is paid according to a table established for the poker hand achieved by the player. Hence, a player might receive odds of 500 to 1 on his bet for a Royal Flush. However, the deal of the cards is not random, but is controlled by the central processing unit in the video poker machine. Thus, the game can be set to deal a Royal Flush not by any random deal of the cards, but only when the house is far enough ahead to where it can afford to make a 500 to 1 pay out while still maintaining the "house" percentage of winnings on that particular machine. While there is some skill involved in playing video poker—that is, a skillful player knows not to throw away a Royal Flush in the hopes of making a pair of aces on the draw—the ultimate outcome is based on the house percentage pre-programmed into the machine. In many states, this type of gambling device is illegal because no matter how skillful a player may be, in the long run the player is never going to do better than the machine is pre-programmed to allow him to do. Many states that will not allow this kind of gaming device will nevertheless allow games that are skill-based where a skillful player may consistently "beat" the house.

States that do not allow gambling devices or "gaming" devices where there can be a large money pay out may, nevertheless, allow coin operated devices where a player may receive a strictly limited reward oftentimes in various kinds of merchandise. These games are sometimes called "redemption" devices. For example, in state fairs or carnivals where one throws a baseball to knock dolls off a shelf or uses a rifle to break clay pigeons and, if successful, one is rewarded with a teddy bear or some similar prize of relatively low value. This is usually permitted in states that do not allow any other types of gaming or gambling devices. This type of game is also seen in video arcade settings where one may win credits that can be applied toward free play of other games or even small prizes, again, like teddy bears, other stuffed animals, or the like. Usually, in redemption games, some element of skill is required to be successful.

Despite the need for new games, there have been very few successful introductions of entirely new games. Among those new introductions are a game called "Caribbean Stud" and a game called "Let-It-Ride". These games are variations of poker where one play against the house. The games can be played with generated hands or randomly shuffled cards. Although from the play of the game it appears the player would have a good chance of winning, the actual odds strongly favor the house resulting in a relatively high percentage of house "take" on the total amount of money wagered on a game in a set period of time. Again, these kinds of games, even though they are based on a randomly generated outcome are illegal in many places because the house, through the rules of the game, has a set percentage or take.

Consequently, it is a challenge for a game designer to design a game that will meet all the different requirements for a successful introduction of a new game, especially in regulatory jurisdictions where games guaranteeing a house percentage or house take are illegal or otherwise not permitted by the regulatory environment. A new game introduction, before it can be successful, should have many desirable features. First, the game should be easy to learn. In the environment where most gaming or arcade machines are placed, a game like chess could never be successful, simply because the rules are so complex and take so long to master that few, if any, novices could be induced to play a game based on chess. Second, if possible, the game should have an appearance to an already known game or device. Hence, games like "Caribbean Stud" that uses the standard poker hands and gradations among the hands as a basis for the play of the game. Thus, anyone who is familiar with poker will quickly orient themselves to the rules of the "Caribbean Stud" game. Third, playing the game should have sufficient interest so that the player will not quickly become bored by the game. That is, play of the game itself should be interesting and fun over a period of time, so that a player will continue to play. Many people are quite willing to spend $10 or $15 or some set sum of money based on their personal income and resources for the enjoyment that playing a game provides for several hours. Arcade games like Pac-Man are popular for this reason. Next, the game should allow a skillful practiced player an opportunity to better the performance of an unskilled or novice player. This is an important factor. First, for many people, the process of learning and mastering a game is part of the fun of the game. Thus, a game like golf, which provides an opportunity to continue to learn and improve one's skills in the game throughout a lifetime, can be highly popular. Second, in many regulatory environments, a game which can be beaten by a sufficiently skilled player may be allowed, where as a game where there is a pre-set house percentage or where the rules of the game provide for the house to always win over a substantial period of time may be illegal.

Consequently, there have been many games or variations of games which attempt to solve these various challenges. For example, Grazebrook, U.S. Pat. No. 3,865,368, discloses an electronic version of the children's game of "Snap". The object of the "Snap" game is to be the first of two players to voice the term "snap" when, from a random stack of cards that each player has, a player turns over matching cards. The Grazebrook '368 patent provides that either two individuals may play against each other or an individual may play against the machine where the machine's response is controlled by a variable time delayed circuit. Morrow et al., U.S. Pat. No. 5,947,820, discloses a computer implemented electronic game that involves completion of a puzzle by the use of simulated slot machine reel. Davids et al., U.S. Pat. No. 5,833,536, discloses a game machine with a video type display that is controlled by a micro processor or CPU. The processor uses a program to generate images of playing cards. A player uses an input device to select a moving card and direct its movement toward a selected card position and a selected one of the card hands locations. If the player does not select a card in time, it is automatically placed on one of the card hand locations by the machine on a random basis. Kelly et al., U.S. Pat. No. 5,584,763, discloses a pointer that rotates on a display face. Control mechanisms allow a player to stop and start rotation of the pointer. A game score is determined based on where the pointer stops on the game face.

Despite these efforts of others, there is still room for a skill-based game controlled by a programmable Central Processing Unit or CPU operated by a player in response to a visual display presented on a display screen.

SUMMARY OF THE INVENTION

In this skill-based game, there will be a video display controlled by a programmable central processing unit. A visual reproduction or simulation of a reel will be displayed to a player, not unlike the reel on a slot machine. A multiple set of reels will be displayed, ordinarily, three, but in some embodiments, more than three or less than three could be used. Displayed on each reel will be a series of symbols. They can be the ordinary slot machine symbols of various fruits. However, in other environments, there can be other types of symbols, for example, different types of balls, like a football, baseball, soccer ball, and so on. Because the processor is programmable, the reel can consist of any convenient number of symbols randomly arranged. If the number of symbols to be displayed on the reel is relatively small, it will be relatively easy for a player to memorize, or partially memorize, the order in which the symbols appear on the reel. Therefore, if a reel has a random ordering of 100 symbols, one might learn, for example, that three lemons appear in a row preceded by a watermelon and followed by two limes. The more reels that are involved in the play of the game and the more symbols that appear on each reel makes the feat of memorization or, at least, of partial memorization more difficult. The simulated reels appear to rotate by progressively moving the image of the individual symbols across the screen to simulate the way a mechanical reel machine like a mechanical slot machine operates.

In an ordinary slot machine that operates mechanically when a player pulls a handle, the reels rotate and randomly stop so that a particular symbol is displayed in the central part of the screen. Then, depending on what symbols are displayed in the central part of the screen, a pay out is made to the player. The pay outs may be arranged so that the slot machine over a period of time will have a pre-set percentage of the take. That is, if the odds for three cherries coming up on the three reels in the central screen are 1000 to 1 but a player is only paid 900 to 1 on his bet, then the house would have a take of 10% for that particular arrangement. The player has no control over what symbols stop in the central part of the screen. That occurs randomly based on the pull of the handle of the machine. Of course, mechanical slot machines while still common can be replaced by an electronic machine, because the same thing can be done electronically with an electronic display of the symbols as opposed to an actual mechanical reel randomly rotating.

This invention requires skill to play the game well. The player, through operation of a stop button, may control what symbol, if any, will appear in the central part of the screen. Therefore, a player who is appropriately skilled who sees a desirable symbol begin to scroll downward from the top of the screen toward the central part of the screen, may push the stop button. If the player successfully times the push of the stop button, the symbol will stop in the central part of the screen. In this way, a skillful player will have at least some control over what symbols appear in the central part of the screen. As an added element, a symbol or symbols may be randomly selected to appear in a bonus window with a special results for a player who can successfully stop one or more symbols that match the "bonus" symbol in the central part of the screen. However, if a player pushes the stop button either prematurely or tardily, the desired symbol will not stop in the central part of the screen. Indeed, no symbol is guaranteed to stop in the central part of the screen. Thus, a player's reflexes and concentration are tested by the device, so that a player who pays close attention and responds quickly to the visual input of the screen is more likely to be successful in either stopping any symbol in the central portion of the screen or stopping a desired symbol in the central portion of the screen. Moreover, the rules of the game can provide for an escalating series of rewards. Thus, a player may revise his strategy during a single play of the game in order to maximize his chances of receiving a reward based on the results the player is able to achieve. Therefore, strategy, memory, and concentration are part of playing the game well even though good reflexes are also helpful. Although it is believed this invention will find its widest use in a video based game environment, it could also be played using mechanical reels. In venues where cash pay outs are legal, the game could be set up to have large cash pay outs, depending on the timing of the reels and the stops, the pay outs in the bonus table, and other variations. However, the game can be equally successful in a redemption game environment where only small prizes are awarded. Again, the timing of the stops, of the bonus tables, and of the rules of the game permit the operator to be successful in receiving sufficient income from play of the game to afford to pay the redemption prizes. Finally, because of the skill involved in playing the game, it is believed the game would be successful in arcade game environments where no prizes are given and where the attraction for a player to play the game is the fun involved in playing the game itself.

BRIEF DESCRIPTION OF THE DRAWINGS

FIG. 3 shows an instruction sheet with pay outs.

DETAILED DESCRIPTION OF THE DRAWINGS

General Description of the Game

Reels

Figure 1:
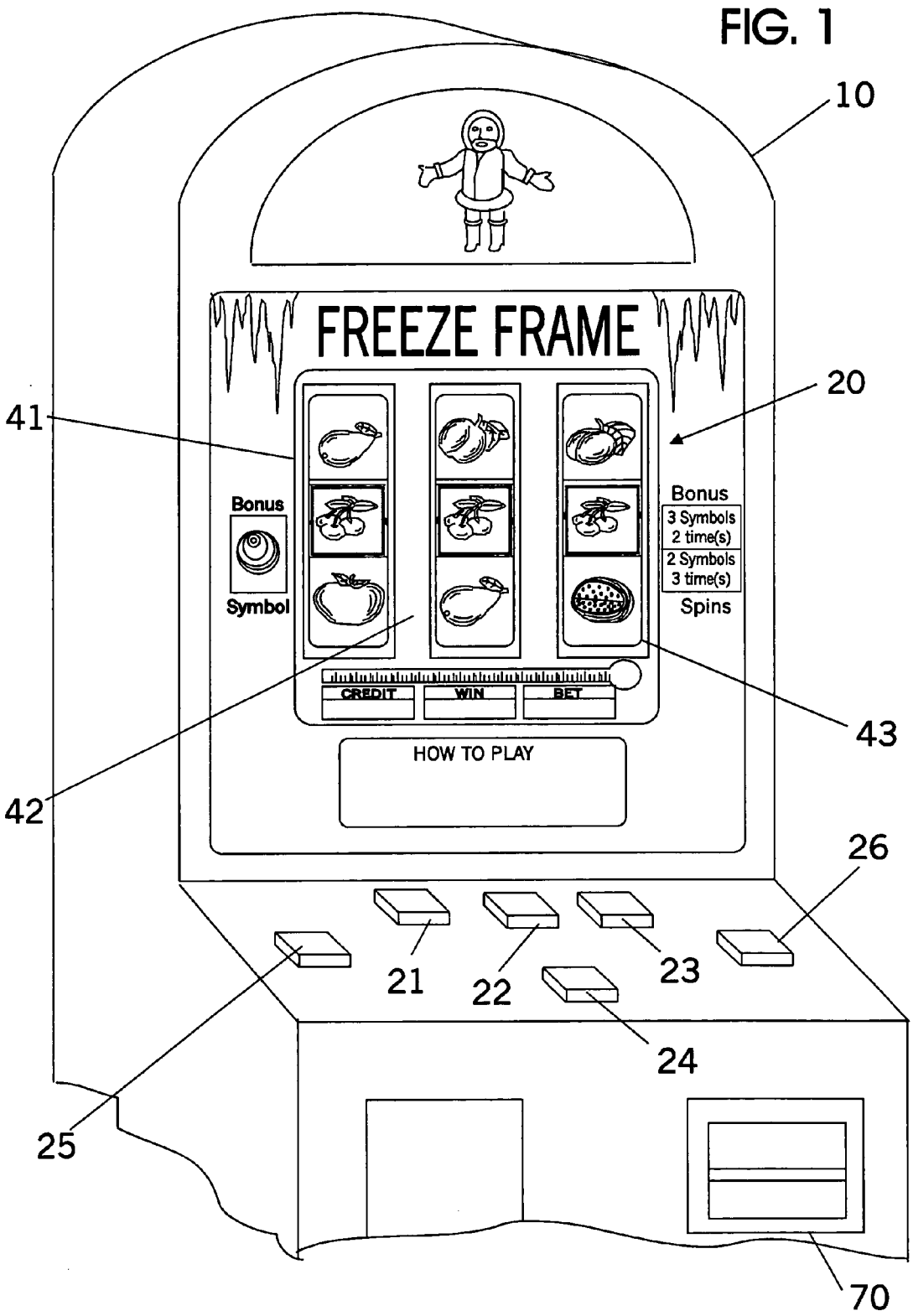
FIG. 1 shows a cabinet containing the game.

This game is played with electronically generated reels. At least two reels will be required to play games, but in most applications three reels or more will be used. Displayed on the reels are discreet representations of different symbols. The symbols could be abstract. More commonly, visual depictions of common objects would be used. In the slot machine, for example, usually different depictions of fruits are used—lemons, limes, cherries, apples, and so on. Because in an electronic based game, even as the reels appear to rotate the order in which the symbols appear on the reel could be changed by the central processing unit controlling the game either randomly or according to some other pre-programmed directive. In this game, however, the symbols that appear on the reel and their order will remain constant during a single play of the game. That is, there will be no shuffle of the symbols on the reel as the reels are rotating in a single play of the game.

The type and number of symbols that appear on a reel will be fixed. That is, for example, there might be ten different type symbols of fruit that appear on the reels. During the play of the game, the symbols on the reel will not suddenly change to an abstract symbol or to a football or something other than the pre-determined and preset symbols, like ten different types of fruit.

As will be discussed later, it may be desirable at some point during extended play of the game that the order of symbols on the reels be changed. Moreover, it may be desirable to give the player of the game the choice of what symbols appear on the reels. Some players may prefer fruit symbols where others may prefer representations of different types of sporting equipment like balls, bats, gloves, tennis rackets, and so on, where still others may prefer abstract symbols. Because of the flexibility that is provided in an electronic based game, all of this is feasible. In a mechanical reel game, the reels would have to be changed in order to change the symbols on the reel, or the order of the symbols on the reel.

Operation of the Stops

As the reels rotate a pre-determined number of symbols will be visible in the viewing window for a user. Typically, three symbols on each reel will be visible. Typically, the reels will appear to rotate with the symbols passing from the top of the viewing window down through the middle of the viewing window and then disappearing at the bottom of the viewing window. This gives the appearance of a rotation of a mechanical reel. Disposed below and aligned with each of the apparent reels that appear on the viewing screen is a stop button. A user presses the "stop button to stop the rotation of the reel. If the user times the pressing of the stop button appropriately, then a symbol will stop in the middle viewing portion of the screen or frame. This is a desirable result. The machine can be programmed so that within a pre-determined time interval pressing the stop button will result in a particular symbol being frozen in the middle viewing area or frame, hereafter called the "freeze frame". A principle part of the skill of the game is timing the pressing of the stop button so that a symbol will be stopped appropriately in the freeze frame. If one presses the stop button prematurely, it may stop the preceding symbol in the freeze frame or it may miss having any symbol stopped in the freeze frame. That is to say, pressing the stop button does not guarantee that any symbol will stop in the freeze frame. If one pushes the stop button too soon, then one may catch a symbol that is apparently rotating on the reel before the desired symbol in the freeze frame or one may catch one symbol half in and one symbol half out. In this event, no symbol is deemed stopped in the freeze frame. By the same token, if one presses too late, one may again have the desirable symbol halfway out of the freeze frame at the bottom with the next symbol halfway in the freeze frame at the top. Again, no symbol is deemed stopped in the freeze frame in this eventuality. One may, of course, randomly press the stop button and, if one is lucky, a symbol will be stopped in the freeze frame. However, careful timing and learning the operating characteristics of the machine enable a skilled user to more often successfully stop a desired symbol in the freeze frame than an unskilled user.

In an electronic based game, the programming of the stops is a simple matter known to one of skill in the art. Ordinarily, the symbols are displayed on a video screen by successively reprojecting the symbols at a different point on the screen ordinarily determined by the number of pixels that define the dimensions of the screen. The central programming unit will know where a symbol is displayed on a screen, since it is responsible for re-displaying the symbol at a different point on the screen following a set interval in order to simulate the appearance of a rotation of a reel. Because the central programming unit knows where the symbol is projected at the screen at any given time, when a player presses the stop button, the stop button will initiate a signal to the central programming unit. If this signal is received at a time when a symbol is displayed on the screen in a desirable location, the central programming unit will recognize a player has successfully "stopped" the symbol in the correct location. Then, depending on the programming of the CPU, the player will be awarded appropriately. The same thing can be accomplished mechanically in which the rotation of the reels is mechanically stopped by the player using a braking device. Again, it is known to one of ordinary skill in the art for operation of mechanical devices as to how to accomplish this goal of providing a reward to a player depending on whether he has successfully stopped an appropriate symbol in an appropriate location.

The Bonus Reel

For most variations of this game, at least one bonus reel operates to cause one of the symbols on the regular reels to appear in a bonus window before the beginning of each game. Thus, one of the symbols that appear on the reel will be selected to be the bonus symbol. The symbol selected as the bonus symbol will vary randomly from game to game. The player then starts the plurality of reels apparently rotating on the visual screen. If the player is able to successfully stop the same symbol as the bonus symbol in the freeze frame, this increases the reward that the player may receive. Also, if a player is successfully able to stop the symbols matching the bonus symbol in the freeze frame, then the player may go into a special bonus round. The appearance of the screen will change so that a multiplying bonus reward will randomly flash in some order on the screen. The player again pushes a stop button to determine the bonus amount to be paid. The actual number of bonus hits required to enter the special bonus round and multiplier factor of the bonus round and the other variations are a matter of choice of the machine operator.

The importance of the bonus symbol is that it contributes greatly to the strategy employed in the game. For example, if a lemon is the "bonus" symbol, the ideal result for a player would be to stop lemons in the "freeze frame". This gives the player the highest opportunity to win. However, if the player is unsuccessful in stopping a lemon in the freeze frame, but by happenstance stops, for example, an apple in the freeze frame, then the strategy of the player may vary. He may still continue to try to stop lemons in the remaining two frames, but it may be to the player's advantage to try to line up three consecutive apples. Again, it would depend on the rules of the game that a particular game operator chooses to employ. But employing a bonus symbol may require a player to vary his strategy, depending on which bonus symbol appears and on the results the player obtains in attempting to stop the bonus symbol or some other symbol in the first freeze frame of that play of the game.

For the operation of this game, one of the advantages that an electronic based game has over a mechanical game is the possibility of a separate bonus round as described above. While in a mechanical game it would be possible to have a separate reel that gives a bonus symbol and to have higher pay outs if a player is successful in stopping one or more of the bonus symbols in the "freeze frame", it is much more difficult to arrange for a bonus round. This would require yet another reel or wheel which would have to be mechanically operated apart from the other reels which greatly complicates and adds to the expense of building the machine. However, in a central processing video based screen machine, it is much simpler to have the central programming unit go into a different graphics sub-routine for the bonus round to change the display on the screen from the display of the apparent reels to a display of a bonus round. The use of sub-routines to change screen display is well known to one of skill in the art of programming for video based game devices.

Skill-Based Game

Because this is an electronically controlled game, the programming of the central processing unit that controls the game permits wide variations. However, for the game, whether mechanical or electronic, to be a skill-based game, certain requirements must be met. First, the rotation of the reels and the time interval that a player has to react to the appearance of the symbol and then to press the stop button must be such that a skillful player with quick reflexes will be able to sometimes successfully stop a desired symbol in the freeze frame. Second, during the play of an individual game the particular symbols on a reel remain fixed. That is, if a lemon appears on a reel and is rotating toward the freeze frame, then if the player successfully presses the stop button so as to stop the lemon within the freeze frame, it will not change to an apple or an orange by operation of the central processing unit. However, within these limitations wide variations are possible to make the game relatively easy so even a casual player can be successful with the game or make it difficult so that it requires a high degree of skill, concentration, and strategy to be successful. The desirability of a central processing unit video based game arises, to a large degree, from the flexibility that such an arrangement provides. However, a mechanical reel based game can provide at least some of the elements of this game that make it desirable. The rotation of the reel speeds can be controlled mechanically, so as to make the operation of the stop challenging but still possible for a quick player who concentrates on the game. A video game using a central processing unit makes possible shuffling of the symbols on the reel, changing of the pay outs, and the like all of which may add to the desirability of the game for the individual players. This is much more difficult to accomplish and with a much smaller scope for variation of the game with a mechanical based game, but it is believed that the major factors for a skill based reel game are possible with a mechanical device.

FIG. 1 shows a cabinet for the preferred electronic embodiment with the game display and controls. A variety of specially designed game boards are available for the game industry. These game boards usually have a central processing unit as well as various plug-in accessories or modules that perform functions related to the operation of the game. Some of the game boards have a CPU which can be utilized with various applications or operating systems that allow a programmer to use programming languages like Basic, C-Plus-Plus, Pascal, and others to control the operation of the game. Typically, the game board is placed inside the cabinet and wired to the video display. The video display is controlled from the game board and its programming. There is a slot for receipt of money which is also wired to the CPU. Typically, there is a printer which will print a ticket for a player or a ticket dispenser to dispense tickets at the conclusion of the player's session with the game. These can be redeemed with appropriate prizes, cash pay outs, or other rewards as determined by the game operator. These general features are common in most video based redemption games, including video slot machines, arcade games, among others, and are well-known to one of ordinary skill in the art.

The game will be housed in a cabinet (10). In the central part of the cabinet (10) is a video display (20). The video display (20) is seen in more detail in FIG. 2. On the console of the cabinet (10) are six buttons. Aligned with the reels (41, 42, 43) on the video screen (20) are three stop buttons (21, 22, 23). On the cabinet (10) console is a start button (24), a "finish" or "collect" button (25), and a "help" button (26). The use of these buttons will be explained in more detail in the description of FIG. 3. To begin the game a player places money in the slot (70) in the front of the cabinet (10).

Figure 2:
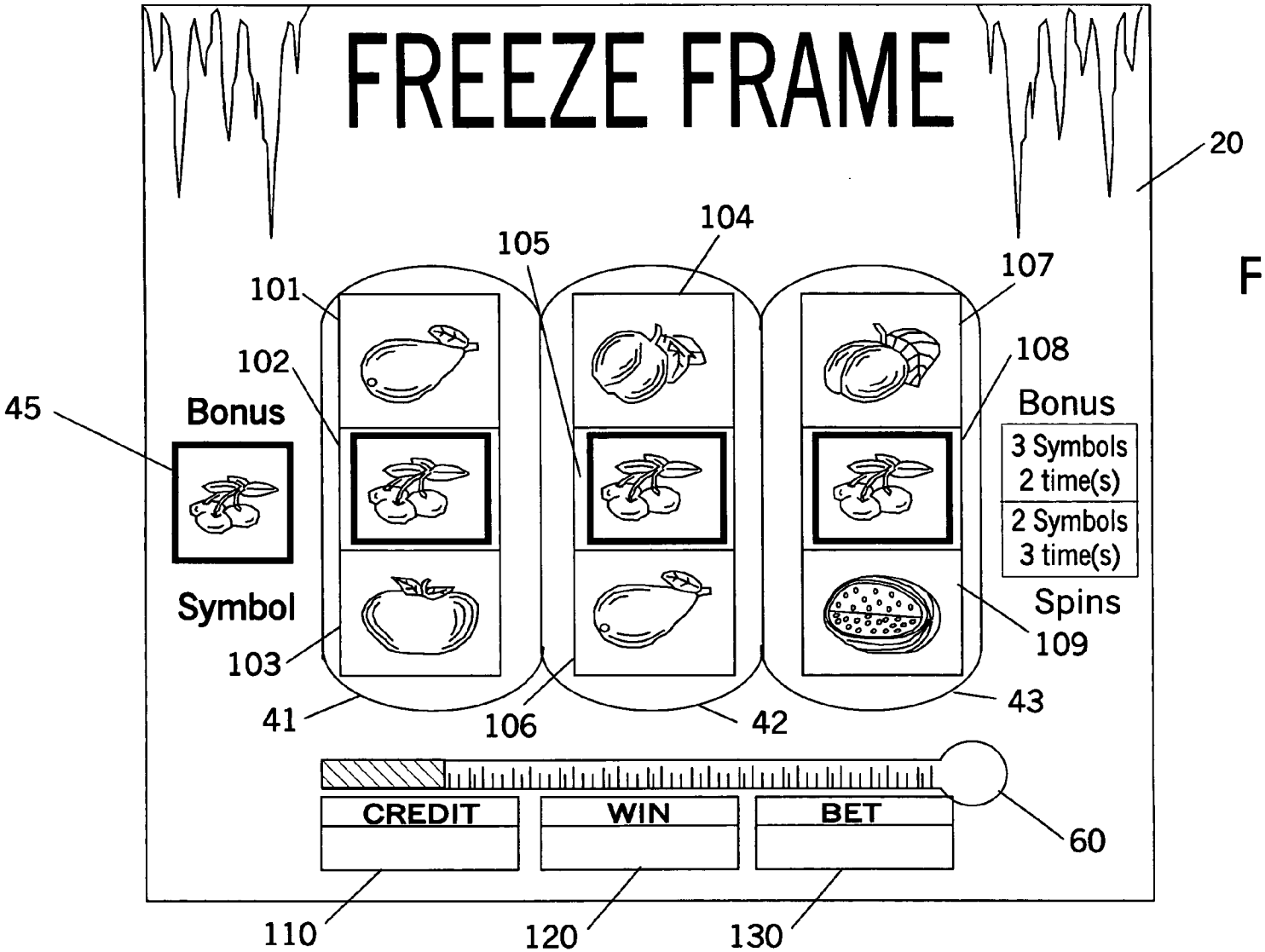
FIG. 2 shows the play screen used in this invention.

Shown in FIG. 2 is the central part of the video display (20). These are the virtual depictations of the reels (41, 42,43). Three separate frames are displayed. Shown displayed in the reels (41, 42, 43) are fruit symbols, although other types of symbols could be employed. The video display (20) is shown in a static fashion but, ordinarily, the fruit symbols move from the top of the screen scrolling from the top frame (101) to the freeze frame (102) and then to the bottom frame (103) for the reel (40). Likewise, the top frame for reel (41) is (104), the freeze frame is (105), and the bottom frame is (106). For the third reel (43) the top frame is (107), the freeze frame is (108), and the bottom frame is (109). Disposed to the left is a single display for the bonus symbol display (45). The bonus symbol display (45) is programmed to randomly display one of the symbols displayed on the reels (41, 42, 43). Immediately below the reels (41, 42, 43) is a thermometer-like display (60). The thermometer-like display (60) is actually a timer. From the time the game starts, the thermometer-like display (60) will gradually fill up with an apparent mercury until the thermometer is entirely full. This means the time to play the game is expired and the player must start again. Below the thermometer are three registers. At the left, a credit register (110) records the credit balance the player has with the game. When a player inserts money into the slot (70), the credit register (110) displays a corresponding credit balance for the amount of money. At the far right is the bet register (130) which records how much a player has decided to bet and the middle or win register (120) records the outcome of a particular game.

FIG. 3 records an instructional display which may be shown on the cabinet or may be made part of the video display. In a regulatory environment where variations permitted to the game operator are strictly limited, operating instructions for the game may be printed on the front of the cabinet (10). In FIG. 1 there is a blank area with the heading "How to Play". This might contain instructional information of the type shown in FIG. 3. However, in some environments of a video game where the game operator may change from day to day or week to week some of the rules by which the game is played, then the area on the front of the cabinet (10) labeled "How to Play" may contain instruction on how to operate the game to display a video screen containing information similar to that shown in FIG. 3. FIG. 3 discloses a variation of the game that is more likely to be seen in an environment that limits or strictly regulates games to relatively low pay outs. Sometimes this is called a "redemption" game.

In the embodiment shown in FIG. 3 the bet is pre-set at 20 credits. To play the game, one inserts at least enough money in the slot (70) in the front of the cabinet (10) to cover one bet In a redemption game environment, credits might simply equal a monetary amount of one cent. Hence, if one inserted a dollar into the slot (70), one would show a credit balance in the credit register (110) of 100 credits. In this embodiment, the bet is pre-set at 20 credits and can not be varied by the player. In some regulatory environments allowing a player to vary the amount of bet, it is considered one of the indicia of a gaming or gambling device as opposed to a skill-based device. Consequently, in the embodiment shown in FIG. 3 for a redemption game environment, the bet is pre-set at a fixed amount. Here, the fixed amount is deemed to be 20 credits. However, the credits could be more or less than one cent in value. If a credit was deemed to have a value of one-tenth of a cent, then inserting a dollar would give a credit account of 1000 and the 20 credit bet would be the equivalent of two cents. On the other hand, if a credit was deemed to be equal to a nickel, then inserting a dollar would give a balance of 20 credits, only enough to play one game. In an arcade game or a redemption game environment, it is expected it should cost less than a dollar to play a game. However, in a casino environment, wide variation may be permitted. In casinos there are "nickel" slot machines up to slot machines that require $100 for a single play of the game. Here, a bet is pre-set at 20, so 20 would appear in the bet register (130). One would press the start button (24) on the cabinet (10). The game would then spin the virtual bonus reel randomly until a bonus symbol would appear in the bonus symbol display (45). Once the bonus symbol appears in the bonus symbol display (45), the reels (41, 42, 43) would appear to rotate, displaying respectively the symbols in the upper frame (101, 104, 107), then the freeze frame (102, 105, 108), and then the bottom frame (103, 106, 109). To attempt to stop a symbol in the middle or freeze frame, one presses the respective stop buttons (21) for reel (41), (22) for reel (42), and (23) for reel (43). However, one only has a limited amount of time to play the game. The elapsed time is shown by means of a thermometer-like display (60). If a player does not play the game within the time provided, there is no penalty. However, the bonus symbol will not change and the order that the symbols appear on the reels will be rearranged and shuffled. The player presses the start button to start the reels (41, 42, 43) rotating again. In the preferred embodiment of this invention, there is no penalty for a player sitting out any number of games. However, it is clear that if it becomes a problem for the operator of the game, then the number of games a player would be permitted to sit out—that is, to allow the timer to elapse—could be limited so that a player would begin to lose part of his credits if he did not play the game within the elapsed time. Once a player, however, has pressed one stop button to stop one of the reels rotating, then the remainder will stop automatically unless the player stops them within the permitted time. The game is set up so that a symbol will never stop in a freeze frame unless the player stops it there. That is, if time merely expires and the symbols stop, they will not be in the freeze frame. Hence, a player cannot let the machine play the game. The player has to play the game in order to win. Under the rules shown for the embodiment in FIG. 3, if a player is able to stop the bonus symbols within any of the three freeze frames (102, 105, 108), it will pay twice his bet, here 40 credits, because the bet is pre-set at 20 credits. The 40 credits will be recorded in the win register (120). If a player hits two bonus symbols—that is, two symbols that match the bonus symbol are stopped in the central freeze frames (102, 105, 108), then the player is paid seventeen and one-half his bet, here, 350 credits. Three bonus hits in the freeze frames (102, 105, 108) would pay 60 times the bet hence, 1200 credits. Of course, if a player stops no symbols in the freeze frame, then the player loses his bet entirely. By the same token, if the player stops two different symbols in the freeze frame, the player does not receive any return on his bet. If a player stops three different symbols in the freeze frame, then the machine may pay some nominal amount, here, four credits or one-fifth of the bet. This gives a novice player the experience of a "win". However, should the player stop the same two symbols in two of the freeze frames, then the player will receive two and one-half his bet and if he stops the same three symbols in the freeze frame, he will receive thirty-five times his bet. This table displayed in FIG. 3 shows how the bonus symbol can affect a player's strategy. For example, suppose a lemon is displayed in the bonus symbol display (45). The player would try to stop three lemons in the freeze frame to receive the pay out of 60 times his bet. However, if he is unable to stop a lemon but by happen stance stops a plum in the first freeze frame, then the player may wish to change his strategy depending on his memory of how the symbols are arranged in the remaining reels and his estimate of the difficulty of stopping plums in the remaining two freeze frames. If he is able to stop three plums in the freeze frame—that is, stopping a plum in the two remaining freeze frames—he will receive 35 times his bet However, if he stops two lemons in the remaining two freeze frames, he will only receive seventeen and one-half times his bet However, that could change depending on whether he has been successful in prior rounds in stopping two bonus symbols in the freeze frame. In this embodiment of the invention, if a player stops two bonus symbols in the freeze frame three times during an extended play of the game, he enters the bonus round. The bonus round will be explained in more detail in the description of FIG. 4 but, briefly put, a bonus round for two bonus symbols pays a potential of 180 times the bet or 3600 credits. Thus, if a player is only playing a few games, he will be more likely to attempt to match plums in the two remaining freeze frames rather than to attempt to get two lemons matching the bonus symbol display (45) in the remaining freeze frames. However, if the player is planning to play the game for an extended period of time or especially if a player has already, on one or more prior occasions, had two "bonus hits", then the player may wish to try for the lemons for the opportunity to enter the bonus round.

Figure 4:
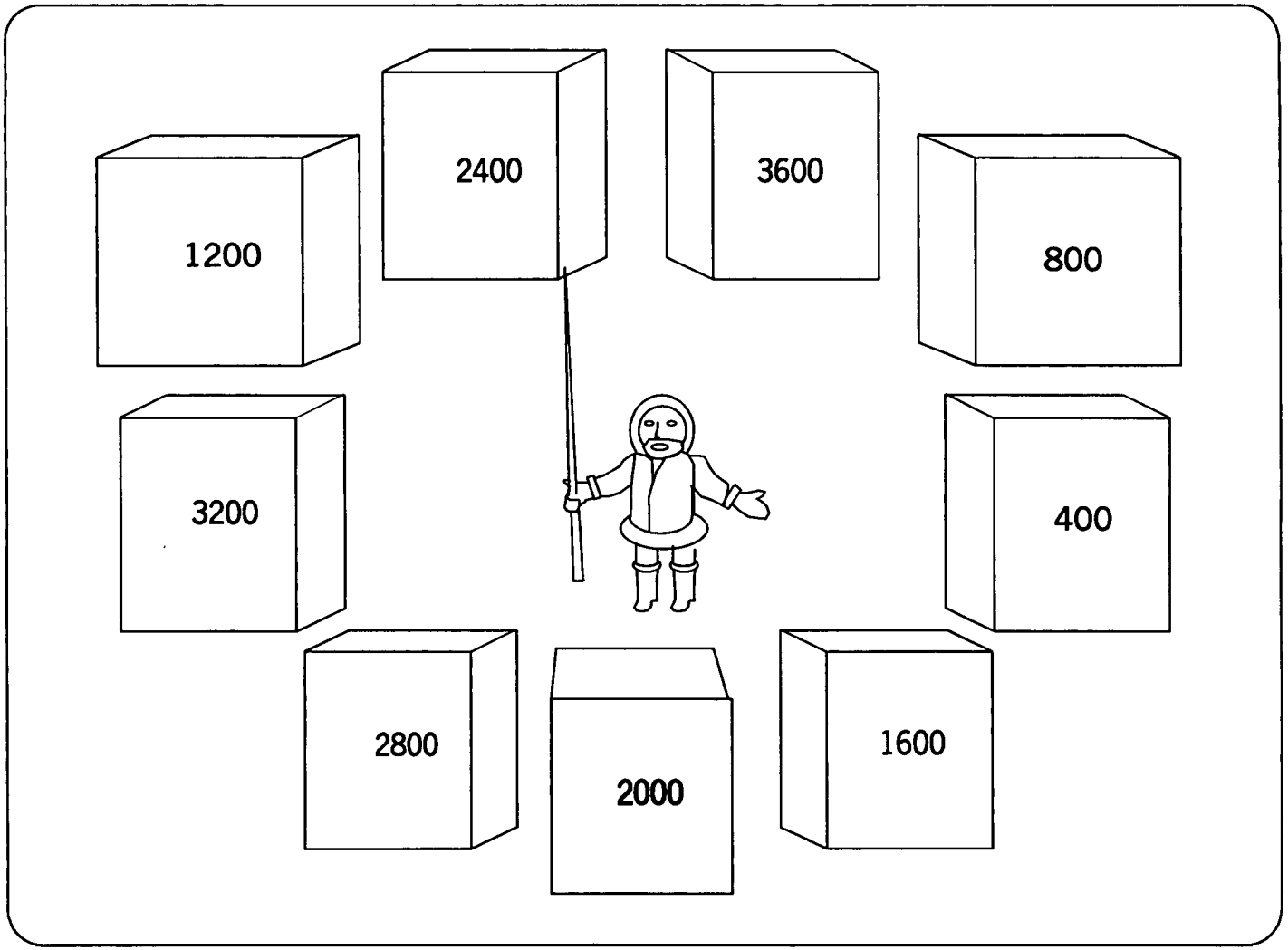
FIG. 4 shows a bonus round used in this invention.

A bonus round is a special display on the video screen. It appears on the video screen when during a session of play a player has met the requirements of the rules to enter the bonus round. In the embodiment shown in FIGS. 1, 2, and 3, a bonus round may be entered according to the rules displayed on the front of the game cabinet (10) on the extreme right of the video display (20). Here, displayed in FIG. 4 is the bonus round for successfully stopping two bonus symbols in the freeze frames on three separate occasions during a session of play of the game. One may also enter the bonus round by successfully freezing three bonus symbols in the freeze frames on two separate occasions during a session of play of the game. The video display shown in FIG. 4 is the same but for the amounts shown in the nine blocks of ice arranged around a central eskimo-like fishing figure. For the two hit bonus rounds shown in FIG. 4, the figure shown in the blocks of ice represent pay outs for entering the bonus round and range from a minimum pay out of 400 credits and increase by 400 credits for each block of ice up to the ninth block of ice which is 3600 credits. For a bonus round for 3 hits done twice the minimum pay out is 900 credits that increase 900 credits per block of ice to a maximum pay out of 8100 credits. Once a player is entered into the bonus round and the display is made, then the blocks of ice begin to flash randomly. The player presses the start button (24) to stop the flashing of the blocks of ice. The player will attempt to time pressing the start button (24) to respond the block of ice with the highest credit hence, will attempt to get a pay out of 3600 credits. The timing of the flashing of the blocks of ice and the time the player is given to stop the flashing is explained in more detail in the discussion of FIG. 5. For the embodiment under discussion, suppose each credit represents one cent. Therefore, the fixed bet is 20 credits or 20 cents. If a player successfully freezes two bonus symbols in the freeze frame, he receives an immediate pay out of 350 credits or $3.50. The second time the player, during this same session of the play of the game, stops two bonus symbols in the freeze frame, he receives another pay out of $3.50. The third time the player stops two bonus symbols in the freeze frame, he receives a third pay out of $3.50 and enters the bonus round as shown in FIG. 4. He will receive a bonus pay out according to the amounts shown in the block of ice which is stopped when he presses the start button (24). If he is able to successfully freeze the bonus amount or the highest amount of 3600 credits, the player will receive an additional pay out of $36.00.

The bonus round for a player who has successfully frozen three symbols in the freeze frame on two occasions provides even higher pay outs. There the pay outs increase from 900 credits up to a maximum of 8100 credits or, in the example given, $81.00.

Variations and the Impact on the Skill Required to Play the Game

Wide variations are permitted within play of the game. These variations provide the operator of the game with ways to make the game more interesting for a player, to vary the pay outs permitted under the game, to comply with various regulatory requirements, and to assure continued player interest in operation of the game. The discussion below will speak of the particular options employed in the preferred embodiment of this invention, but will also discuss variations permitted within the general scope of the invention.

Reels

The operation of the reels are an important part of the game. Because the reels are an electronic simulation of a physical reel, great variation is permitted by game programming. Typically, for the game to operate as a skill-based game, each reel must employ multiple symbols with at least one of each symbol on each reel. In the preferred embodiment, there are ten different fruit-like symbols. Therefore, the minimum number of symbols that could be employed on each reel are ten—one for each of the ten fruit symbols used in the preferred embodiment. If the reels employ more than ten symbols, this can both increase the difficulty of the game for the player or conversely make achieving higher pay outs easier. If a very high number of symbols are employed to constitute a reel—say, 1,000—then it will be very difficult for a player, by observation of the reels, to remember or recognize in what order the symbols appear. On the other hand, if a relatively large number of symbols are employed, then it is possible to have a consecutive run of the same symbol to appear on the reel. Given a random shuffle of the reel, then for a player that is able to recognize this run of symbols, it would significantly simplify the task of stopping that particular symbol within the freeze frame. It has been found in practice that 110 symbols on each reel are a good compromise and are the number used in the preferred embodiment. If 110 symbols are employed on each reel, then 11 of each different fruit symbols appears on the reels. This means no symbol is more or less common on the reel than any other symbol. In the preferred embodiment, a multiplying factor will be used to determine the total number of symbols, here 11.

If 110 symbols are employed on each reel and a player plays a game for a prolonged period of time and carefully observes the reels, in time he will learn the order in which the symbols appear on the reel. This will be a real advantage to a persistent player who concentrates and employs his full power of memorization. Indeed, it has been found in practice that a skillful player that is prepared to patiently play the game over a substantial period of time can memorize the order of symbols on the reel and more easily stop a desired symbol in the freeze frame. Consequently, it may be necessary for the operator of the game to occasionally shuffle the order of the symbols on the reel. Such a shuffle is not permitted during the actual rotation of the reel during any one game. Otherwise, this would significantly reduce the skill from the game. It has been found in practice that a shuffle after twenty plays of the game is a number that will allow a skillful player, who employs his full powers of concentration and memory, an advantage over an unskillful player, but will make it difficult for a skillful player to easily beat the game. If a skillful player can easily beat the game, then the game will lose interest for that skillful player.

The more the symbols on the reel differ from each other, the easier it is for a player to perceive and respond to the perception of that symbol as it rotates on the reel. For example, a group of three cherries with the accompanying leaves, stems, and red-colored cherries differ substantially in appearance from the yellow lemon. This is in contrast to symbols that might employ common elements like a soccer ball, a golf ball, and a baseball, all of which are round and white. It will take a good player only a very small amount of time to recognize the cherry symbol as it begins to scroll down in the simulated rolling of the reel, but a longer amount of time to distinguish an apple from a plum. If the operator of the game chooses to employ symbols that are visually similar, then the speed of the reels could be decreased giving the player a greater amount of time to respond. In the preferred embodiment of this invention, it is desirable to use fruit symbols because they strike an appropriate balance between ability to readily perceive and react to their appearance to the speed of the rotation of the reels. Moreover, fruit symbols are traditionally used on slot machines and players are generally familiar and comfortable with those symbols, which is a desired feature for a game that can be used in a game room or casino environment In a purely random shuffle of the reels that occurs periodically in a game, the same symbol could bunch up on the individual reels. That is to say, if 110 symbols appear on a reel using ten different symbols, then potentially as many as 11 of the same symbol could appear in a consecutive order on the reel. It has been found in practice that if a shuffle is used, then the CPU is programmed not to permit more than two of any symbol to appear in a consecutive series on the reels. This is necessary to avoid the game becoming so easy that a skillful player will lose interest in playing the game.

The Bonus Symbol

In the preferred embodiment of this invention, only one bonus symbol is used and a player enters the bonus round whenever he is able to stop two or more of the bonus symbols in the freeze frame a fixed number of times during a session of play at the game. That is, one would not enter the bonus round until one had stopped a pre-determined number of the bonus symbols. This requires that a player play more than one game to be able to enter the bonus round no matter how skillful. This variation constitutes an incentive for a player to continue play of the game beyond a single play. Also, if a player is required to have a higher number of bonus symbols than can be achieved in any one game, this would permit a higher multiplier to be used in the bonus round but without otherwise changing the requirements of the game. In some game environments, players prefer the opportunity for very high pay outs, even though the odds may be long or great skill required to reach that level of pay out. However, wide variations are permitted within the scope of this invention. For example, a separate bonus window could appear above each of the reels so that a player might be trying to stop as a bonus symbol of lemon in the first reel, an orange in the second reel, and a lime in the third reel. If this arrangement is used, this would, to some degree, increase the difficulty of the game.

Timing of the Game

Because this game, to some degree, depends on the action and reaction time of the players, the timing of the game is critical. There are several different time levels or intervals which are important in the game. These will be discussed in turn.

First, the apparent rotation of the reels cannot be allowed to go on indefinitely. A player must, at some point, press the stop button. If a player was allowed to sit and observe the game for extended periods of time, he would be able to memorize the symbols on the reels and the order in which they appear and would greatly increase his opportunity to match the bonus symbols. By giving the player a limited amount of time in which to play the game, it forces a player to play the game. In the preferred embodiment of the game, there is no penalty to a player who allows the time allowed to play the game to expire. But if time to play the game expires and the player has not pressed any stop buttons, then the order of symbols on the reels are shuffled. This prevents memorization. Also, in the preferred embodiment, the amount of the bet is fixed. This prevents a player from making a low wager then, when he has memorized the order of symbols on each reel, increasing the wager. That is, he does not lose any part of his bet on a game where the player did not press any stop buttons during the rotation of the wheels. However, if it proves that many players would simply watch the reels rotate without actually playing the game, then some penalty might be required (i.e., the player might lose a certain percentage of his bet whenever he allowed the time to expire without actually playing the game). Under the preferred embodiment, 20 seconds are given for the players to stop the wheels. If it cost a very small amount, say five cents to play the game, then this time might be reduced where as if it costs a much larger amount, say five dollars to play the game, the time might be extended.

By the same token, a player is given a limited amount of time during the bonus round to stop the bonus symbols from flashing and therefore to select the multiplier to be applied to his bet when a player has successfully entered the bonus round. In the preferred embodiment of this game, 15 seconds are given for the player to stop the bonus round, hence to select a particular bonus pay out. If, during this 15 seconds, the player does not select a bonus amount by pressing the start button, then the machine will automatically select the lowest possible multiplier.

Perhaps the most critical timing event is the time the player has to stop a particular symbol within the freeze frame. That is, as a player observes the apparent rotation of the reel, a desired symbol will approach the freeze frame, will be in the freeze frame, and then will pass out of the freeze frame. It is while the desired symbol is in the allowed window for the freeze frame that the player must press the stop button in order to stop that symbol within the freeze frame. This time interval must be long enough to allow a skillful player a reasonable opportunity to succeed.

Figure 5:
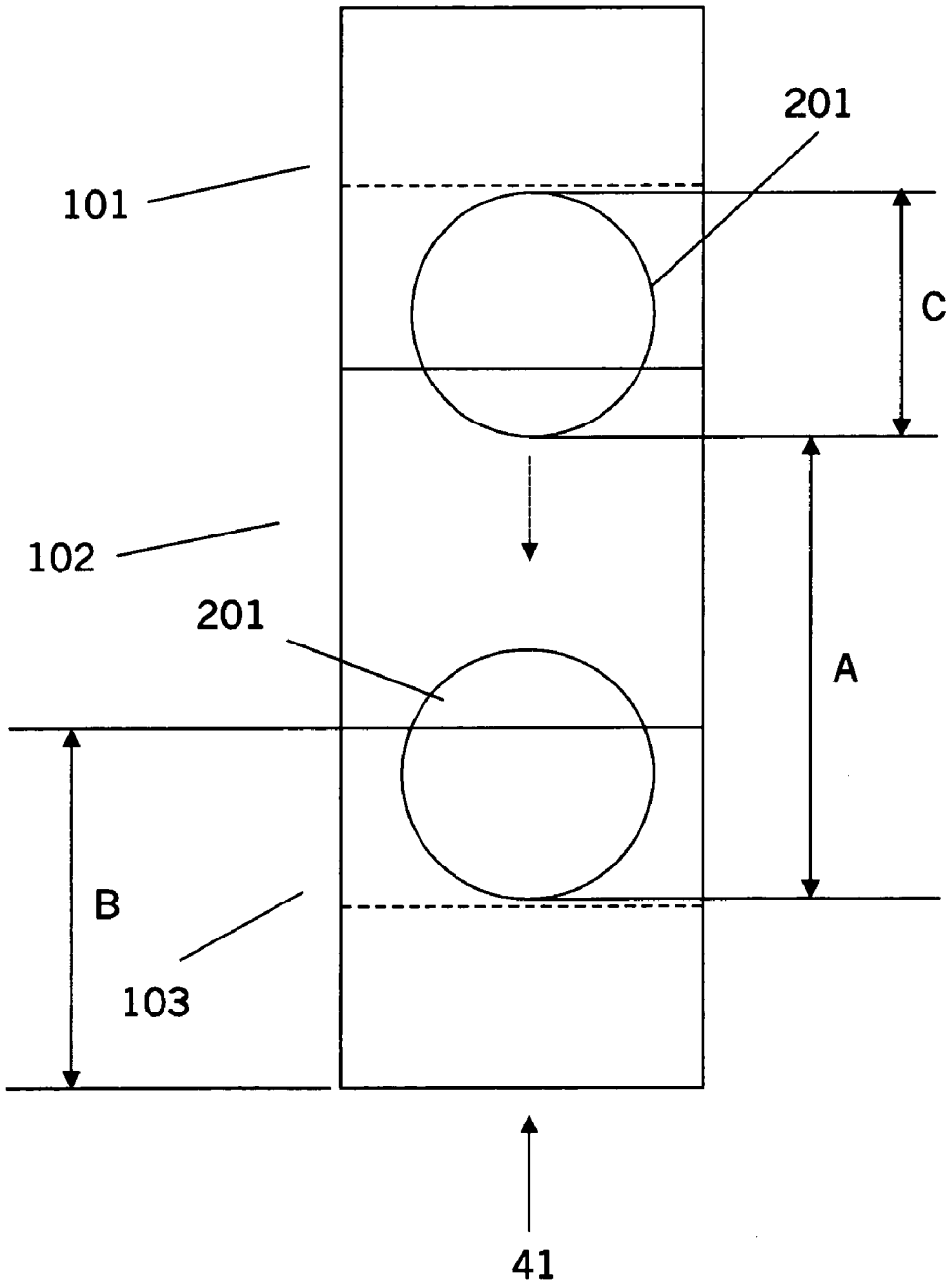
FIG. 5 is a stylized rendering to explain the timing of the invention.

FIG. 5 shows the reel (41) in frames (101, 102, 103). In the preferred embodiment of the game, a symbol (201) rotates from the top frame (101) through the freeze frame (102) and into the bottom frame (103) and then out of the frame entirely. However, one must keep on mind what is actually shown here is a portion of a cathode ray tube controlled by a central processing unit. Therefore, there is no actual movement of anything. Rather, the cathode ray under the control of the central processing unit first projects a symbol at one place on the screen, then the projection of the symbol is moved to a second place on the screen, and so on. However, the human eye does not perceive a series of stops and starts, but rather a continuous motion if the projection and reprojection is fast enough. This is the principle behind both television and movie theaters. For example, in a movie theater the lighted projector displays a discreet series of frames of the film as it scrolls through the projector. Nevertheless, one sees a continuous action on the screen because of the way the brain operates. In the preferred embodiment of this invention, every 41/1000 of a second the symbols are reprojected 21 pixels lower on the cathode ray screen. Consequently, the symbols apparently move at a speed of 512 pixels per second. In the preferred embodiment, each frame (101, 102, 103) is 82 pixels, the distance shown by (B) in FIG. 5. The symbol (201) is approximately 54 pixels in the longitudinal dimension. This dimension distance shown by (C) in FIG. 5.

As the symbol (201) apparently scrolls through frames (101, 102, 103), the player must press the stop button in order to stop the symbol (201) within the freeze frame (102) in order to "win" the game. Under the programming in the preferred embodiment, if symbol (201) is more than halfway through frame (101) and the player presses a stop button, then the machine will deem the symbols stopped within the freeze frame (102). A dotted line bisects the frames (101) and the frame (103). By the same token, if the symbol (201) is not yet halfway into frame (103) when the stop button is pushed, then the machine will deem the symbol (201) stopped within the freeze frame (102) and show it there. Consequently, it is the amount of time it takes a symbol to move the distance shown as (A) in FIG. 5 that constitutes the window of opportunity for the player to stop the symbol within the freeze frame. This distance is approximately 110 pixels in the preferred embodiment. Because the symbol moves at a rate of 512 pixels per second, this gives a window of opportunity of approximately 215/1000 of one second for a player to press the "stop" (21) to "freeze" the symbol (201) within the freeze frame (102).

Studies have shown that what is usually called a simple reaction time varies widely depending on the age and the physical capabilities of an individual. At the very fastest reaction time is approximately 105/1000 of a second with a common simple reaction time for people in their twenties of approximately 200/1000 of a second. Older people or people who are tired or under the influence of drugs or alcohol have slower reaction times.

However, success in this game is not determined solely by one's reaction time. The allowed reaction time of 215/1000 of a second is within the reaction time of many, if not a majority of, people. However, practice and skill also play a part. A person can learn that there is a delay between where one perceives the symbol to be and the time it takes the brain to order the hand to push the stop button and the hand to actually react to push the stop button. Consequently, a player whose reaction time may be somewhat slower need not wait until the symbol is in the position shown in frame (102) in FIG. 5, but rather can "lead" the symbol just as a shooter may lead a bird by actually pointing the gun in front of the bird when pulling the trigger. Thus, a person could react and attempt to push the stop button when the symbol is actually at some point still outside the window of opportunity, but understanding that the hand will not react to the order to push until the symbol is within the window of opportunity. This is a skill that is developed by practice.

If one is required to not only simply react to a stimuli but also to perceive and then make a decision based on that perception, the reaction time is considerably slowed. If every symbol that rotated on the reel was the same, then the simple reaction time would be close to the reaction time required from a player. However, here different symbols appear on the reel (41), in the preferred embodiment 10 different fruit symbols. This introduces an element of perception and cognitive response to that perception. However, an experienced player can learn the order of which the symbols appear on the reel. This allows an experienced player who concentrates on the symbols and memorizes their order to reduce the perception and cognitive part of the reaction time bringing that person's performance close to the ideal simple reaction time. This introduces an element of strategy in the game. Learning the order of the symbols on a reel allows the player to watch for a known sequence. If the player knows that two cherries are followed by two lemons, then the appearance of two cherries will tell the player that the next two symbols to rotate into view will be two lemons. Therefore, the player can anticipate the appearance of a lemon and reduce the time to respond to the appearance of the lemon by the perception and cognitive times, which will not be required under these circumstances.

As mentioned before, introducing a bonus symbol also adds an element of skill and of strategy to the game. Because capturing the bonus symbols within the freeze frame result in higher pay outs or entering the bonus round, a skillful player is motivated to recognize the order in which bonus symbols appear on the reels and to be ready to respond to those bonus symbols. However, if a player is unsuccessful in stopping a bonus symbol in his play on the first reel (41), then he may change his strategy on the second reel (42) and the third reel (43).

It will be appreciated by one of skill in the art that wide variations are permitted. For example, one could slow the apparent rotation of the symbols but make the window of opportunity smaller while still resulting in an approximate window of opportunity of 215/1000 seconds. By the same token, one could make the window of opportunity shorter in time but increase the pay out ratios for a successful player. If the game operator never shuffled the order of the symbols on the reels, then in time with practice players could know the entire order of the symbols on the reel. This would completely remove the issue of perception and cognitive times from the question of the reaction time. Thus, a player whose simple reaction time was quicker than the allowed interval of 215/1000 seconds would almost always be able to stop the desired symbol within the reel. Thus, for a player who has memorized the order of the symbols on the reel, it would be as if every symbol on the reel was the same symbol. This would become boring to a player of that skill level. Consequently, it is advisable to shuffle the order of symbols on the reels. The operator of the game should seek to strike a balance so that a dedicated player with a good memory and who concentrates will be able to learn enough about the order of the symbols on the reels to increase his likelihood of winning the game. This rewards skill, concentration, and patience. It has been found in practice that approximately 20 plays of the game should be allowed between shuffling the order of symbols on the reels.

For the timing of the bonus round shown in FIG. 4, the player presses the start button (24) to stop the ice cube symbols from flashing. The symbols in the bonus pay out flash or are activated for 0.180 seconds. The order of flashing is random. The very quickest players who carefully concentrate on a chosen symbol will occasionally be able to chose a desired bonus multiple represented the chosen symbol by pressing the start button (24) at the appropriate time. However, because a player is unlikely to be in a bonus round often and because the flashing of the symbols is random, memory and strategy play less of a role in successfully playing in a bonus round than they do in playing of the game itself.

It will be appreciated by one of ordinary skill in the art that wide variations are possible from the description of the preferred embodiment given above, while staying within the spirit and purpose of the game of providing a skill-based game where perception, memory, concentration, practice, and quick reactions are rewarded. Nothing in the above description should be limiting to the scope of the invention which is defined by the claims which follow.

I claim:

1. A rotating reel based game apparatus requiring patience, skill, knowledge, and concentration to play well comprising:

(a) a plurality of reels;

(b) a plurality of pre-determined fixed symbols, with said symbols randomly distributed on each of said reels;

(c) means for displaying a portion of said reels to a player so that for each of said reels at least two full symbols of said symbols on each of said reels are simultaneously displayed;

(d) means for rotating each of said reels;

(e) for each reel of said plurality of reels, a player controlled means for stopping said means for rotating;

(f) for said player controlled means for stopping, means for timing said player controlled means for stopping whereby when said player controlled means for stopping is used, said means for displaying at least two full symbols displays at least one of said two full symbols that were displayed when said player controlled means for stopping was used;

(g) a pre-determined location within said portion of said reels that is displayed to said player;

(h) means for determining if a symbol of said two full symbols of said plurality of fixed symbols on each of said reels is stopped within said pre-determined location;

(i) a results table to determine the outcome of the play of said game based on whether said player has timed the operation of said stops whereby at least one of said pre-determined fixed symbols is stopped within one of said pre-determined locations;

whereby said player plays said rotating reel based game by initiating means for rotating each of said reels then using said player controlled means for stopping for each of said reels to attempt to stop said symbol of said two full symbols within said pre-determined location according to said results table to maximize the results for said player.

2. A rotating reel based game apparatus requiring patience, skill, knowledge, and concentration to play well of claim 1 wherein said means for rotating each of said reels rotates said reels at a rotational speed so that means for timing operates so that said player has a time interval at least one-tenth of a second to use said player controlled means for stopping to stop the rotation of the reels whereby the player may control if a symbol of said two full simultaneously displayed symbols of said plurality of said fixed symbols is stopped within said pre-determined location.

3. A rotating reel based game apparatus requiring patience, skill, knowledge, and concentration to play well of claim 2 wherein a bonus window randomly displays one of said plurality of pre-determined fixed symbols, said display occurring prior to initiating said means for rotating each of said reels, and said results table to increase results based on whether said player has timed the operation of said player controlled stops whereby a symbol of said two full symbols is stopped within one of said pre-determined locations for said plurality of reels by said player that matches said symbol displayed in said bonus window whereby said player uses said player controlled means for stopping to attempt to stop in said pre-determined location symbols matching said symbol displayed in said bonus window to obtain increased results thereby.

4. A rotating reel based game apparatus requiring patience, skill, knowledge, and concentration to play well of claim 3 wherein the same total number of said plurality of pre-determined fixed symbols are randomly distributed on each of said plurality of fixed reels.

5. A rotating reel based game apparatus requiring patience, skill, knowledge, and concentration to play well of claim 4 wherein said plurality of pre-determined fixed symbols is a fixed amount and a fixed multiple number of said fixed amount of symbols is randomly distributed on each of said reels whereby for each individual symbol each reel will have that said multiple number of said individual symbol displayed on said reel so that no symbol appears more or less frequently than any other symbol on said reel whereby said player can use concentration and memory to anticipate the order of symbols on said reels maximizing player's opportunity to activate said means for stopping within said time interval according to said results table.

6. A rotating reel based game apparatus requiring patience, skill, knowledge, and concentration to play well of claim 5 further comprising a timer so that when game is started by initiating said means for rotation of said reels to begin game that said player has a fixed amount of time to operate said player controlled means for stopping for each of said reels.

7. A rotating reel based game apparatus requiring patience, skill, knowledge, and concentration to play well of claim 6 wherein said symbols are constrained to stop outside of said pre-determined location at expiration of said fixed amount of time unless player has used said player controlled means for stopping within said fixed amount of time determined by said timer to stop said reel whereby a player must use said player controlled means for stopping within said fixed amount of time to stop at least one of said pre-determined fixed symbols within said pre-determined location to obtain favorable results from said result table thereby requiring skill from a player to be successful in play of said game.

8. A rotating reel based game apparatus requiring patience, skill, knowledge, and concentration to play well of claim 7 wherein if a player is successful in stopping a pre-determined number of said two full symbols of said symbols displayed in said bonus window in said pre-determined location, then player is awarded by a special bonus table.

9. A rotating reel based game apparatus requiring patience, skill, knowledge, and concentration to play well of claim 8 further comprising a game counter to record how many games have been played.

10. An electronic video based apparatus for simulating a rotating reel game that requires patience, skill, knowledge, and concentration to play well comprising:

(a) means for displaying to a player on a video screen a plurality of reels;

(b) means to make said means for displaying said plurality of reels to appear to rotate said reels by successively projecting on said video screen images of a reel at differing locations on said video screen;

(c) means for displaying on each of said reels a plurality of full symbols, said plurality of full symbols simultaneously displayed;

(d) for each of said plurality of reels, player controlled means to stop said apparent rotation of said reels;

(e) means for timing said player controlled means to stop whereby when said player controlled means to stop is used said means for displaying a plurality of full symbols displays at least one of said plurality of full symbols that was displayed when said player controlled means to stop was used;

(f) means for determining whether player has used said means to stop so that at least one of said plurality of full symbols is stopped within a predetermined location on said video screen;

(g) means for determining results of said play of game based on whether said player used said means to stop whereby at least one of said plurality of full symbols is stopped within one of said predetermined locations.

11. An electronic video based apparatus for simulating a rotating reel game that requires patience, skill, knowledge, and concentration to play well of claim 10 wherein said means for timing said player controlled means to stop allows a player at least one-tenth of a second to use said means to stop at least one of said plurality of simultaneously displayed full symbols within said pre-determined location on said video screen.

12. An electronic video based apparatus for simulating a rotating reel game that requires patience, skill, knowledge, and concentration to play well of claim 11 further comprising a means for displaying a bonus symbol to a player, said bonus symbol one of said plurality of full symbols, with said bonus symbol display occurring randomly prior to activating said means for displaying to a player on a video screen a plurality of reels, and said means for determining results of said play providing increased results based on whether a symbol of said plurality of full symbols matching said bonus symbol is stopped within one of said pre-determined locations by said player.

13. An electronic video based apparatus for simulating a rotating reel game that requires patience, skill, knowledge, and concentration to play well of claim 12 wherein each of said plurality of said reels has the same total number of said plurality of pre-determined fixed symbols.

14. An electronic video based apparatus for simulating a rotating reel game that requires patience, skill, knowledge, and concentration to play well of claim 13 wherein said plurality of pre-determined fixed symbols is a fixed amount, and a fixed multiple number of said fixed amount of pre-determined fixed symbols is randomly distributed on each of said reels, whereby each reel will have for each individual symbol that fixed multiple number of said individual symbols displayed on said reel whereby no symbol appears more or less frequently than any other symbol on said reel.

15. An electronic video based apparatus for simulating a rotating reel game that requires patience, skill, knowledge, and concentration to play well of claim 14 which further comprises a timer so that when said means for displaying a plurality of reels begins to operate, said player has a fixed amount of time to operate said means to stop.

16. An electronic video based apparatus for simulating a rotating reel game that requires patience, skill, knowledge, and concentration to play well of claim 15 wherein said fixed symbols are constrained to stop outside of said pre-determined location at expiration of said fixed amount of time unless player has used said means to stop within said fixed amount of time determined by said timer to stop said reel.

17. An electronic video based apparatus for simulating a rotating reel game that requires patience, skill, knowledge, and concentration to play well of claim 16 that further comprises means for shuffling said random distribution of said symbols on each of said reels, said means for shuffling constrained to operate only between games and not during play of a game.

18. An electronic video based apparatus for simulating a rotating reel game that requires patience, skill, knowledge, and concentration to play well of claim 17 wherein said means for shuffling is constrained so that no more than two of any same symbol will be in succession on a reel but where said symbols are otherwise randomly distributed on each of said reels.

19. An electronic video based apparatus for simulating a rotating reel game that requires patience, skill, knowledge, and concentration to play well of claim 18 wherein said means for shuffling is constrained to operate after a pre-determined number of games has been played.

20. An electronic video based apparatus for simulating a rotating reel game that requires patience, skill, knowledge, and concentration to play well of claim 19 wherein a said fixed amount of time determined by said timer expires without a player using means to stop said reels, then said means for shuffling is activated for each of said reels but said symbol displayed in said bonus symbol remains the same until player uses said means to stop said apparent rotation of said reel.

21. An electronic video based apparatus for simulating a rotating reel game that requires patience, skill, knowledge, and concentration to play well of claim 20 wherein if a player is successful in using said means to stop a symbol of said plurality of full symbols matching said bonus symbol in said pre-determined location, then player is awarded by a special bonus table.

22. An electronic video based apparatus for simulating a rotating reel game that requires patience, skill, knowledge, and concentration to play well of claim 21 further comprising a game counter to record how many games have been played.

23. An electronic video based apparatus for simulating a rotating reel game that requires patience, skill, knowledge, and concentration to play well of claim 20 wherein if a player is successful using said means to stop symbol of said plurality of full symbols matching said bonus symbols are stopped in said pre-determined location, then player enters a bonus round, said bonus round comprising a bonus round display on said video screen, said bonus round display further comprising a plurality of flashing symbols, each of said flashing symbols containing a number, each of said numbers different in each of said flashing symbols and wherein there is a second means to stop that is used to stop said flashing of said symbols whereby a player receives a reward multiplied by said number appearing in said flashing symbol stopped by said player using said second means to stop.

24. An electronic video based apparatus for simulating a rotating reel game that requires patience, skill, knowledge, and concentration to play well of claim 23 wherein said second means to stop allows a player at least one-tenth of a second to signal a stop of said flashing bonus symbols.

25. An electronic video based apparatus for simulating a rotating reel game that requires patience, skill, knowledge, and concentration to play well of claim 24 wherein said means to stop allows a player at least two-tenths of a second to stop at least one symbol of said plurality of full symbols within said pre-determined location on said video screen.

26. A method for playing a rotating reel game that requires patience, skill, knowledge, and concentration to play well comprising:

(a) providing a plurality of reels;

(b) providing a means to make said reels appear to rotate;

(c) providing a means for displaying on each of said reels a plurality of full predetermined fixed symbols, said plurality of full symbols simultaneously displayed;

(d) providing a means for a player to stop said apparent rotation of said reels;

(e) providing a means for timing said means for a player to stop so that when said means for a player to stop is used, said means to make said reels rotate is stopped while one of said plurality of full predetermined fixed symbols, displayed when means to stop was used, is still displayed;

(f) providing a means for determining if a player has used said means to stop so that at least one of said plurality of full symbols of said predetermined fixed symbols is stopped within a predetermined location on said means for displaying;

(g) providing a means for determining results of said play of said game based on whether said player has used means to stop whereby at least one of said plurality of full symbols of said predetermined fixed symbols is stopped within one of said predetermined locations.

27. A method for playing a rotating reel game that requires patience, skill, knowledge, and concentration to play well of claim 26 further comprising providing said means for timing gives at least one-tenth of a second for a player to use said means to stop at least one of said plurality of full symbols of said pre-determined fixed symbols within one of said pre-determined locations.

28. A method for playing a rotating reel game that requires patience, skill, knowledge, and concentration to play well of claim 27 further comprising providing a means for displaying a bonus symbol to a player, said bonus symbol one of said plurality of said pre-determined fixed symbols with said bonus symbol display occurring randomly prior to activating said means for displaying to a player a plurality of reels and said means for determining results of said play providing increased results based on whether a symbol of said plurality of full symbols matching said bonus symbol is stopped within one of said pre-determined locations by said player, each of said reels of said plurality of reels is provided with the same total number of said plurality of pre-determined fixed symbols.

29. A method for playing a rotating reel game that requires patience, skill, knowledge, and concentration to play well of claim 28 wherein each of said reels is provided with a fixed multiple number of a fixed amount of said pre-determined fixed symbols whereby each of said reels will be provided with the same fixed multiple number of said individual symbols displayed on said reel so that no symbol appears more or less frequently than any other symbol on said reel.

30. A method for playing a rotating reel game that requires patience, skill, knowledge, and concentration to play well of claim 29 which further comprises providing a timer so that said player has a fixed amount of time to operate said means to stop.

31. A method for playing a rotating reel game that requires patience, skill, knowledge, and concentration to play well of claim 30 further providing a means for shuffling said random distribution of said symbols on said reel, said means for shuffling constrained to operate only between games and not during play of a game.

32. A method for playing a rotating reel game that requires patience, skill, knowledge, and concentration to play well of claim 31 further comprising providing a special bonus table wherein if a player is successful in using said means to stop a pre-determined number of said fixed symbols of said plurality of full symbols visually perceived by a player matching said bonus symbol in said pre-determined locations then player is awarded by said bonus table.

33. A method for playing a rotating reel game that requires patience, skill, knowledge, and concentration to play well of claim 32 of providing a bonus round conditioned upon a player successfully using said means to stop a pre-determined number of fixed symbols matching said bonus symbols in said pre-determined location, said bonus round further comprising providing a bonus display, said bonus round display comprising a plurality of flashing symbols, each of said flashing symbols containing a number, each of said numbers different in each of said flashing symbols and a second means to stop is used to stop flashing of said symbols whereby a player receives a reward multiplied by said number appearing in said flashing symbols stopped by said player using said second means to stop.

34. A method for playing a rotating reel game that requires patience, skill, knowledge, and concentration to play well of claim 33 wherein a player is provided at least one-tenth of a second to use said second means to stop said flashing bonus symbols.

35. A method for playing a rotating reel game that requires patience, skill, knowledge, and concentration to play well of claim 34 wherein a player is provided at least two-tenths of a second to use said means to stop at least one of said pre-determined fixed symbols of said plurality of full symbols visually perceived by a player within said pre-determined location.

* * * * *